US006164462A

United States Patent [19]

Mumford

[11] Patent Number: 6,164,462

[45] Date of Patent: Dec. 26, 2000

[54] PULL-OUT GRAVITY FEED SHELF

[75] Inventor: Nicholas R. Mumford, London, United Kingdom

[73] Assignee: L&P Property Management Company, South Gate, Calif.

[21] Appl. No.: 09/407,584

[22] Filed: Sep. 28, 1999

[51] Int. Cl.[7] ..... A47F 5/00

[52] U.S. Cl. ..... 211/59.2; 108/102; 108/143; 211/90.02; 211/90.03; 211/175

[58] Field of Search ..... 211/59.2, 90.01, 211/90.02, 90.03, 90.04, 175; 108/102, 143; 248/241

[56] References Cited

U.S. PATENT DOCUMENTS

| | | | |
|---|---|---|---|
| 2,357,668 | 9/1944 | Laham . | |
| 3,561,714 | 2/1971 | Zurawski | 248/243 |
| 4,128,177 | 12/1978 | Bustos . | |
| 4,602,570 | 7/1986 | Lee . | |
| 4,620,489 | 11/1986 | Albano . | |
| 4,646,658 | 3/1987 | Lee . | |
| 4,736,689 | 4/1988 | Stanko . | |
| 4,905,847 | 3/1990 | Hanson . | |
| 4,953,714 | 9/1990 | Paul . | |
| 5,078,281 | 1/1992 | Johnson . | |
| 5,205,524 | 4/1993 | Cohen | 211/175 X |
| 5,673,801 | 10/1997 | Markson | 211/90.02 X |
| 5,715,957 | 2/1998 | Mere | 211/90.02 X |
| 5,720,230 | 2/1998 | Mansfield . | |
| 5,735,589 | 4/1998 | Herrmann et al. | 108/102 X |
| 5,970,887 | 10/1999 | Hardy | 108/143 X |
| 6,021,908 | 2/2000 | Mathews | 211/90.02 |

*Primary Examiner*—Robert W Gibson, Jr.
*Attorney, Agent, or Firm*—Wood, Herron & Evans, LLP

[57] ABSTRACT

A display rack including shelf assemblies which are movable between a retracted position and an extended position. Each shelf assembly includes a pair of slides adapted to slidably receive a pair of support arms extending forwardly from vertical uprights of the display rack. Each slide has a cavity therein in which one of the support arms is slidably received. The shelf may be locked in either an extended position or a retracted position.

20 Claims, 4 Drawing Sheets

PULL-OUT GRAVITY FEED SHELF

FIELD OF INVENTION

This invention relates to display racks for storing and displaying product and, more particularly, to display racks having extendible shelves which may be pulled out to facilitate stocking of product.

BACKGROUND OF THE INVENTION

Display racks are commonly used in supermarkets, grocery stores and the like to display various items including individual bags of chips or other snacks. Such products have a limited shelf life due to the nature of the product packaged. In order to maintain fresh product on the shelves of the display rack, it is desirable to move the older product forwardly to the front of the shelves where it will be removed by the consumer. Newer, fresher product is preferably placed toward the rear of the shelf so that the older product located at the front of the shelf is removed before the newer product, thus avoiding any loss of product due to the product becoming stale. Such display racks commonly have fixed shelves secured to vertical uprights of the display rack. When stocking product on such shelves, in order to place product toward the rear of the shelf, the loader must reach back behind the existing product located at the front of the shelf in order to stock the rear portion of the shelf with new product. Such loading practices are time consuming and onerous on the individual loading the shelves of the display rack.

Another inherent difficulty with display racks having fixed shelves is that the upper shelves tend to obstruct the customer's line of sight to goods located toward the rear of the lower shelves.

As a result of these difficulties, several pull-out or extendible shelves have been developed for use in display racks. Such pull-out shelves extend outwardly like a dresser drawer to permit stocking of product, product rotation and easy access to the shelf by the customer.

U.S. Pat. No. 5,720,230 discloses a pull-out shelf which extends forwardly from a pair of shelf brackets secured to the vertical uprights of a display rack. The shelf disclosed in this patent is a solid shelf utilizing a pair of three-part telescopic sliders on each side of the shelf in order to enable the shelf to pull outwardly to an extended position and to be pushed inwardly to a retracted position.

U.S. Pat. Nos. 4,602,570 and 4,646,658 both disclose pull-out shelves for use in a display rack. The shelf disclosed in U.S. Pat. No. 4,646,658 has a two-part side support on each side of the shelf, each section or part having a slot therethrough in which a screw rides. The shelf itself is divided into different sections which are hingedly connected and are adapted to fold together when the shelf is retracted and unfold when the shelf is pulled out. Similarly, U.S. Pat. No. 4,602,570 discloses a pull-out shelf having side supports which are telescopically mounted within one another so as to enable the shelf to be extended. Each of these shelves and shelf supports utilizes a plurality of movable components which increases the cost of manufacturing such a shelf assembly and increases the risk of the shelf becoming jammed.

Additionally, each of the pull-out shelves disclosed in these prior art patents is horizontally oriented. With horizontally oriented shelves, product located at the rear of the shelf does not move forwardly so, consequently, the customer must reach between the shelves in order to remove product if product is not located at the front of the shelf. In order to provide product which moves forwardly toward the front of the shelf, it is common to decline the shelf so as to enable gravity to move the product forwardly to the front of the shelf where it is more easily accessible to the consumer. Applicant's own U.S. Pat. No. 4,128,177 discloses a display rack utilizing such gravity feed shelves. However, such gravity feed shelves are usually not extendible.

Therefore, it has been one objective of the present invention to provide a display rack having gravity feed shelves which are extendible so as to enable a merchandiser to easily stock and rotate product.

It has been a further objective of the present invention to provide a display rack having pull-out gravity feed shelves which enable the shelves to be placed closer together increasing the "pack out" or amount of product which may be displayed on the rack.

It has been a further objective of the present invention to provide a display rack having pull-out gravity feed shelves which is simpler and less expensive to manufacture than previously known display racks having pull-out shelves.

SUMMARY OF THE INVENTION

The invention of this application which accomplishes these objectives comprises a display rack having a base and a pair of uprights extending upwardly from the base, a pair of support arms extending forwardly from the uprights and a shelf assembly supported by the support arms. The pair of support arms are fixed to the uprights at the same vertical height and are declined slightly as they extend downwardly and away from the vertical uprights of the display rack. Each of these support arms has a projection at an outer end of the support arm in the form of an upwardly extending hook. Although the preferred embodiment of the present invention utilizes a hook-shaped projection, the projections may assume other shapes/forms as well.

Each shelf assembly of the present invention is supported by a pair of support arms and slidably engaged with the pair of support arms so that the shelf assembly may be pulled outwardly to an extended position and pushed inwardly to a retracted position. Because the support arms are declined, the shelf assembly is declined, enabling gravity to aid in moving product towards the front of the shelf assembly.

Each shelf assembly comprises a wire shelf and a pair of slides secured to the wire shelf on opposite sides of the wire shelf. Each of the slides comprises an inner bracket and an outer bracket secured together. Each of the brackets has a recess. The recesses of the inner bracket and the outer bracket cooperate to define a cavity therebetween when the brackets are joined together to create one of the slides. One of the support arms is slidably received inside the cavity and adapted to slidably move inside the cavity of the slide.

The cavity has a first cavity extension and a second cavity extension located generally above the remainder of the cavity. The first cavity extension is located forwardly of the second cavity extension. The cavity extensions preferably have a hooked-shaped configuration but may assume other configurations depending upon the shape of the projections of the support arms. The hooks or projections of the support arms are secured in the first cavity extensions when the shelf assembly is in the retracted position and are secured in the second cavity extensions when the shelf assembly is in the extended position. In order to move the shelf assembly from the retracted position to the extended position, the front of the shelf assembly is pushed rearwardly and lifted upwardly, disengaging the projections of the support arms from the first cavity extensions and enabling the slides to move forwardly with the help of gravity, the support arms sliding rearwardly inside the cavities of the slides until the projections of the support arms engage the second cavity extensions thus locking the shelf assembly in the extended position. In order to retract the shelf assembly, the shelf assembly is lifted upwardly slightly and pushed inwardly toward the vertical uprights, the slides sliding rearwardly on the support arms until the projections of the support arms are again locked into the first cavity extensions of the slides.

The wire shelf of the shelf assembly comprises a generally planar supporting portion and a rear portion, the rear portion extending upwardly from the rear of the supporting portion of the wire shelf. The rear portion of the wire shelf acts as a stop preventing product from falling rearwardly off the wire shelf. The generally planar supporting portion is the portion of the wire shelf on which the product rests.

Each of the slides of the shelf assembly is secured to an outermost wire of the wire shelf. Each outermost side wire of the wire shelf is located within a groove formed in at least one of the brackets of a slide. Thus, the outermost side wire of the wire shelf is sandwiched between the two brackets of the slide, securing the slide and wire shelf together.

The shelf assembly further comprises a front extrusion secured to the front of the wire shelf and extending between the opposed slides of the shelf assembly. The front extrusion has a receptacle which snaps onto the wire shelf. The front extrusion acts as a stop preventing product from falling off the front of the shelf. The front extrusion also is configured so that a product-identifying label may be placed therein in order to identify product displayed on the wire shelf.

The last component of the shelf assembly is a plurality of dividers removably secured to the wire shelf. The dividers are removably secured to the wire shelf so that they may be secured to different locations on the wire shelf thus enabling different sized products to be placed between adjacent dividers on the wire shelf. A pair of adjacent dividers and the wire shelf define a track adapted to support a column of products.

The structure of the shelf assembly of the present invention enables the shelf assembly to be moved between an extended position and a retracted position and locked in either position. This advantage and other advantages of the present invention will become more readily apparent from the following description of the drawings.

DETAILED DESCRIPTION OF THE DRAWINGS

Figure 1:
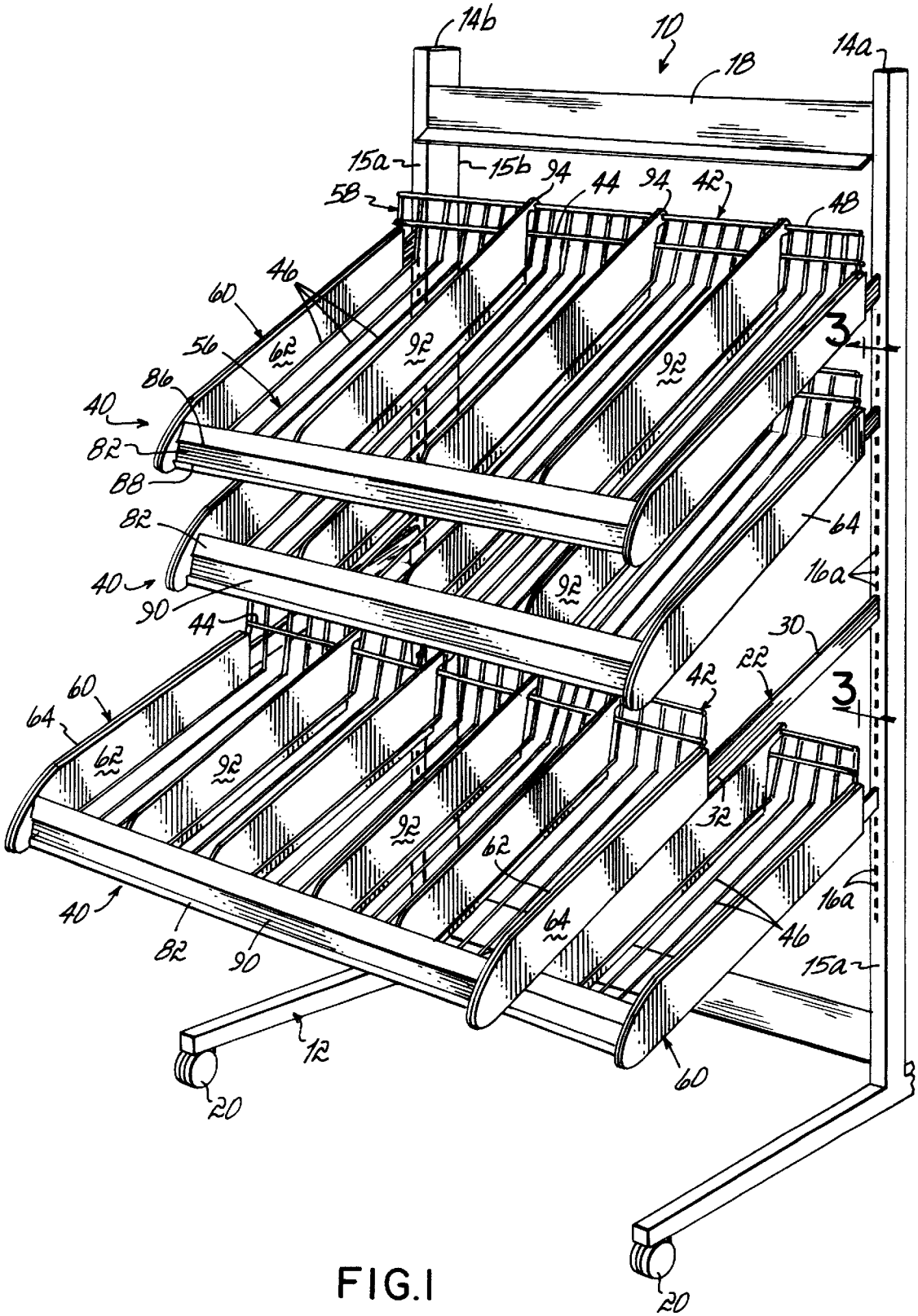
FIG. 1 is a perspective view of the display rack of the present invention, one of the shelf assemblies being illustrated in an extended position, the other shelf assemblies being illustrated in a retracted position.

Referring to FIG. 1 of the drawings, there is illustrated a display rack 10. The display rack 10 has a base 12 and a pair of vertical uprights 14*a*,14*b* extending upwardly from the base. Although one type of base is illustrated, other types of bases may be used in accordance with the present invention. Each of the vertical uprights 14*a*,14*b* has a generally rectangular cross section including a front wall 15*a* and a back wall 15*b* (see FIG. 3). The front wall 15*a* has a series of spaced slots 16*a* and the back wall 15*b* has a series of spaced slots 16*b*. Extending between vertical uprights 14*a*, 14*b* at the top of the display rack 10 is a header 18. The base of the display rack may be supported by a plurality of caster wheels 20. The caster wheels may be omitted if desired in order to increase the stability of the display rack.

Figure 2:
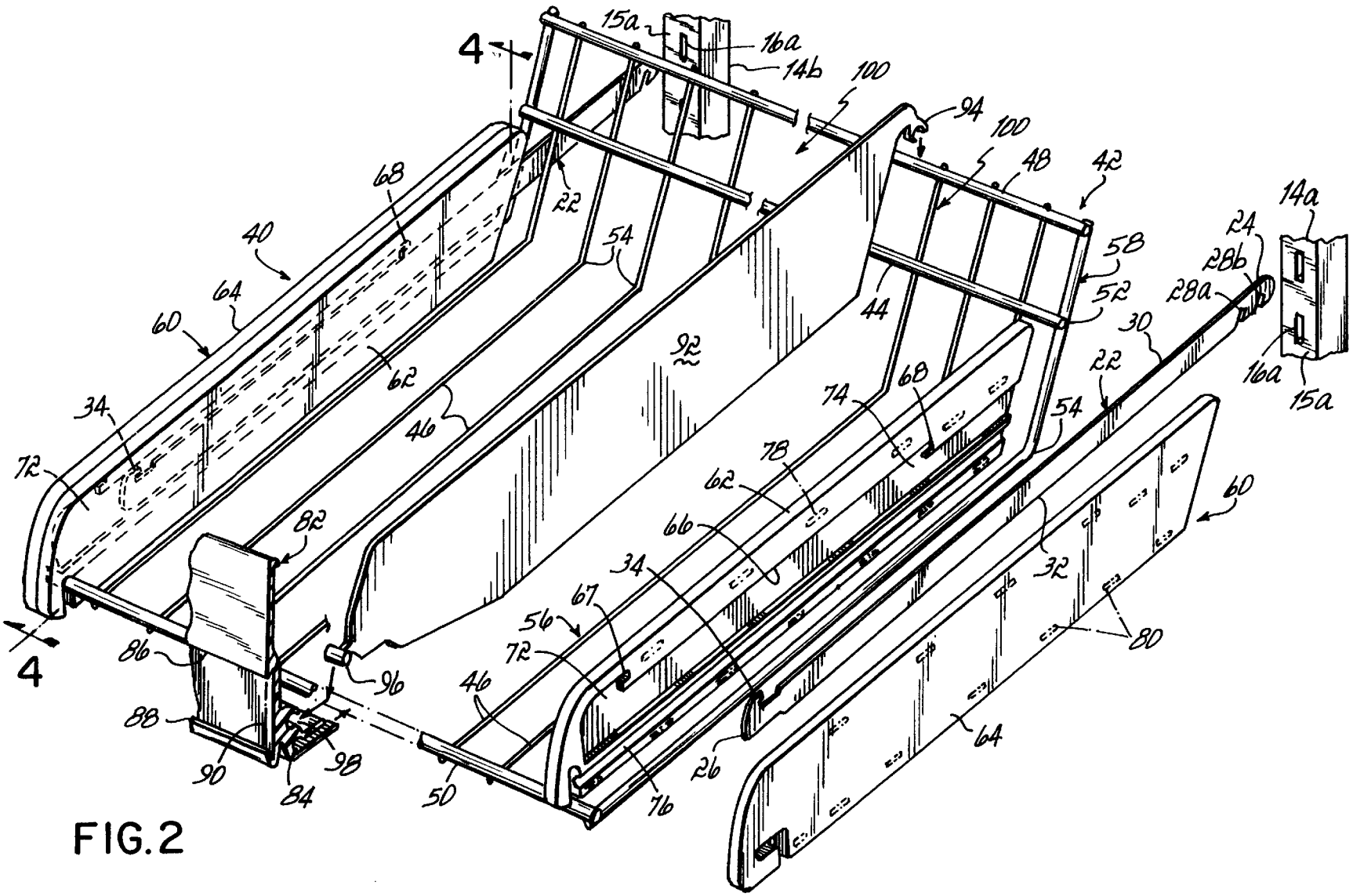
FIG. 2 is a partially exploded view of one of the shelf assemblies of the present invention illustrating the relationship between the uprights of the display rack, the support arms of the display rack and the shelf assembly.
Figure 3:
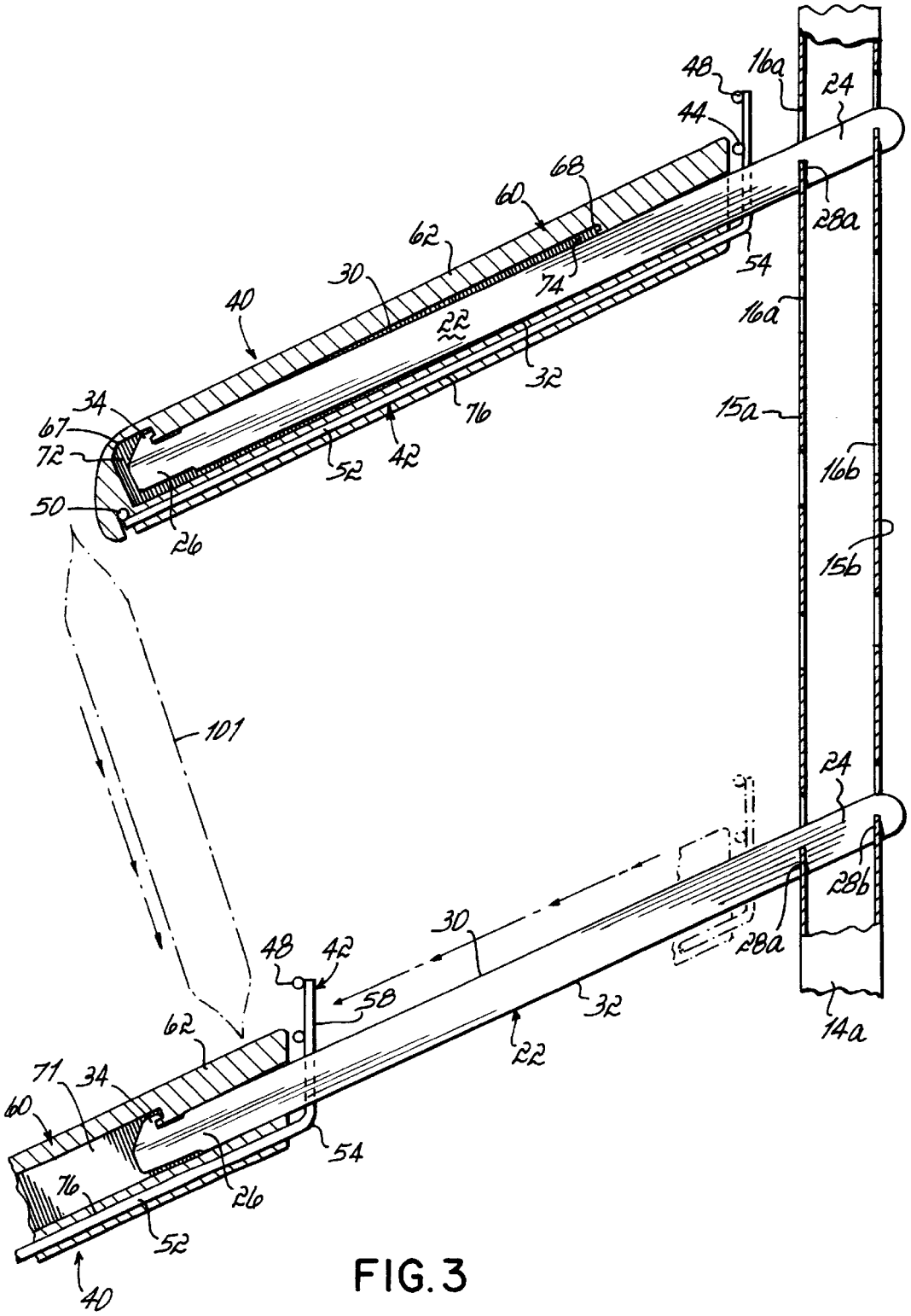
FIG. 3 is a view taken along the line 3—3 of FIG. 1.

FIG. 1 also illustrates a plurality of support arms 22 removably secured to the vertical uprights 14*a*,14*b*. As best illustrated in FIGS. 2 and 3, each of the support arms 22 has an inner end 24 and an outer end 26. The inner end 24 of the support arm 22 contains a pair of cutouts 28*a*,28*b* (see FIG. 2). As best illustrated in FIG. 3, cutout 28*a* engages front wall 15*a* and cutout 28*b* engages back wall 15*b* in order to secure the support arm 22 in place. The angle of the cutouts 28*a*,28*b*, relative to the top and bottom edges 30, 32 of the support arms 22 determine the angle of declination of the support arms 22. As best illustrated in FIGS. 1 and 3, each of the support arms 22 is declined so that the inner end 24 of the support arm is located above the outer end 26 of the support arm 22 so as to enable gravity to feed product downwardly to the front of the shelf where it is readily accessible to the consumer.

As best illustrated in FIGS. 2 and 3, at the front of each of the support arms 22, proximate the outer end 26 of the support arm 22, is a hook-shaped projection 34. The hook-shaped projection 34 extends upwardly and rearwardly and is used to lock a shelf assembly 40 in either a retracted position or an extended position. As best illustrated in FIGS. 1 and 3, each shelf assembly 40 is supported by a pair of the support arms 22 and is movable between a retracted position and an extended position.

FIG. 2 illustrates the details of the shelf assembly 40. The shelf assembly 40 comprises a wire shelf 42 and a pair of slides 60. The wire shelf 42 comprises a plurality of longitudinal wires 44 and a plurality of transverse wires 46. The longitudinal wires 44 and traverse wires 46 are joined by welding or any other method at their points of intersection. The wire shelf 42 further comprises a rearmost longitudinal wire 48, a front longitudinal wire 50 and a pair of opposed outermost side wires 52 which make up the perimeter of the wire shelf 42. Each of the transverse wires 46 is bent at a location 54 so as to define a generally planar supporting portion 56 and a rear portion 58, the rear portion 58 extending upwardly from the supporting portion 56.

In addition to the wire shelf 42, the shelf assembly 40 comprises a pair of slides 60 secured to the wire shelf and, more particularly, to the outermost side wires 52 of the wire shelf. As illustrated in FIG. 2, each of the slides 60 comprises an inner bracket 62 and an outer bracket 64. Inner bracket 62 has a recess 66, including a first recess extension 67 and a second recess extension 68. Similarly, outer bracket 64 has a corresponding recess 70 (see FIG. 5) with first and second recess extensions (not shown). The recesses 66,70 of the brackets 62,64 cooperate to define a cavity 71 in which one of the support arms 22 is slidably received.

Figure 4:
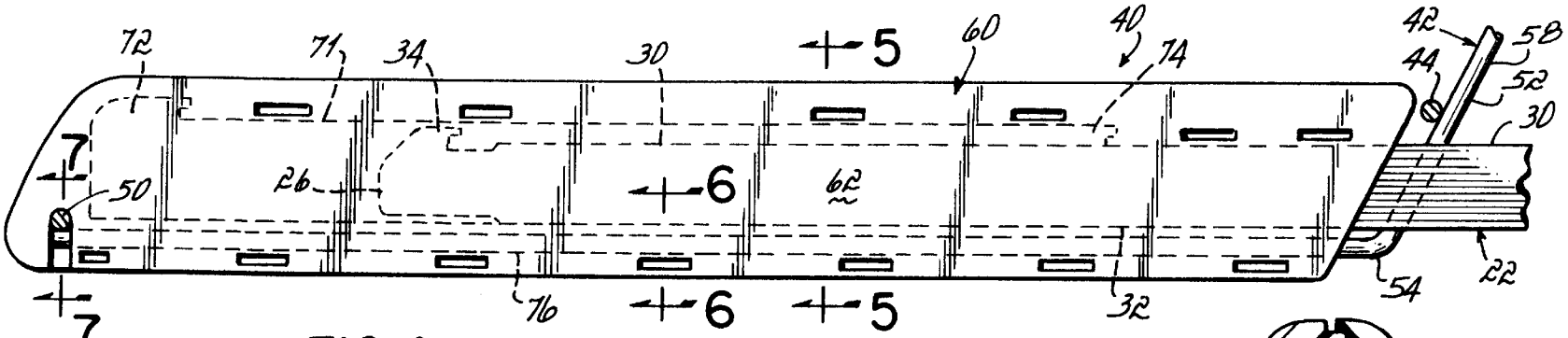
FIG. 4 is a cross-sectional view taken along the line 4—4 of FIG. 2.

As best illustrated in FIGS. 3 and 4, the cavity 71 has a first cavity extension 72 and a second cavity extension 74.

Each of these cavity extensions is generally hook-shaped and adapted to receive and retain the projection 34 of the support arm 22. The first cavity extension 72 is located proximate the front of the cavity 71 and the second cavity extension 74 is located proximate the rear of the cavity 71. FIG. 3 illustrates a shelf assembly 40 held and retained in the retracted position with the projections 34 of the support arms 22 being engaged with the first cavity extensions 72 of the cavities 71 of the slides 60. FIG. 3 also illustrates a shelf assembly 40 in the extended position with the projections of the support arms engaged with the second cavity extensions 68 in order to hold and retain the shelf assembly 40 in an extended position.

As best illustrated in FIG. 2, the inner bracket 62 of each of the slides 60 has a longitudinally extending groove 76 which is adapted to receive and retain the outermost side wire 52 of the wire shelf. Although the groove 72 is illustrated as being formed on the inner bracket of the slide, it may just as well be formed on the outer bracket or, alternatively, on both brackets. The groove 76 may assume different configurations and locations in accordance with the present invention.

Figure 5:
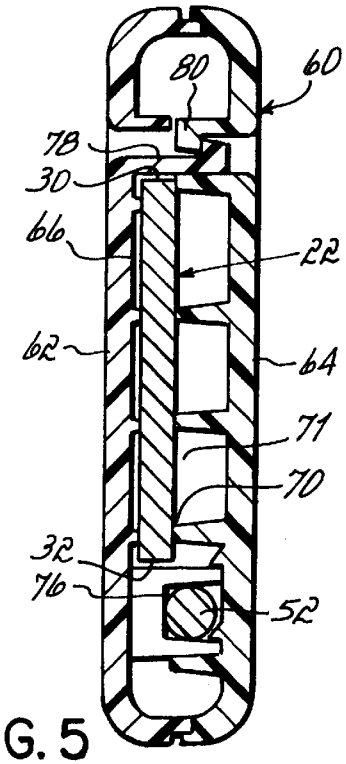
FIG. 5 is a cross-sectional view taken along the line 5—5 of FIG. 4.
Figure 6:
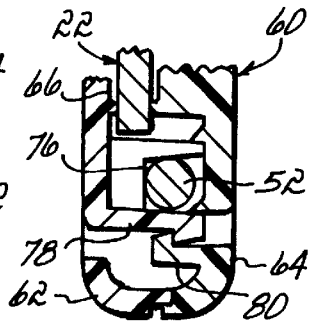
FIG. 6 is a cross-sectional view taken along the line 6—6 of FIG. 4.
Figure 7:
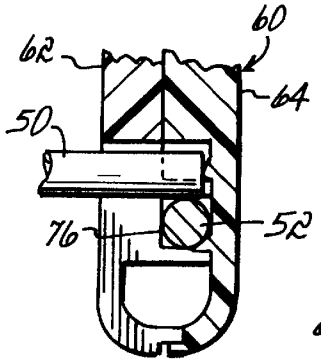
FIG. 7 is a cross-sectional view taken along the line 7—7 of FIG. 4.

As best illustrated in FIGS. 5 through 7, the inner and outer brackets 62,64 of each slide 60 are secured together. Each inner bracket 62 has at least one locking arm 78 and outer bracket 64 has at least one locking arm 80. The locking arms 78,80 engage one another and function to lock the inner and outer brackets together with one of the support arms 22 therebetween (see FIG. 5). Also, one of the outermost side wires 52 of the wire shelf 42 is located between the inner and outer brackets once the brackets are locked together.

As best illustrated in FIG. 2, the shelf assembly 40 also comprises a front extrusion 82. The front extrusion 82 extends between the slides 60 of the shelf assembly and is connected to the front longitudinal wire 50 of the wire shelf. More specifically, the front extrusion 82 has a longitudinally extending receptacle 84 into which the front longitudinal wire 50 of the wire shelf 42 is retained. Due to the engagement between the front extrusion 82 and the front longitudinal wire 50 of the wire shelf, the front extrusion 82 may be removed and replaced if desired. The front extrusion 82 further has a longitudinally extending upper lip 86 and a longitudinally extending lower lip 88 which are used to hold and retain one or more product identifying labels 90 illustrated in phantom in FIG. 2.

Figure 8:
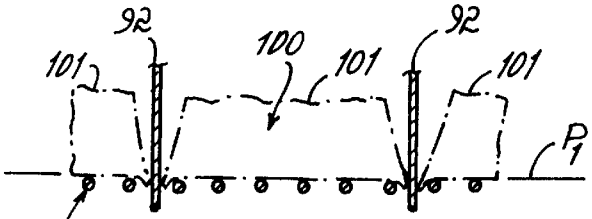
FIG. 8 is a view of a portion of a shelf assembly of the present invention illustrating the relationship between the dividers and the wire shelf.

Another component of the shelf assembly 40 is a plurality of dividers 92. As best illustrated in FIG. 2, each divider 92 is removably secured to the wire shelf 42 and extends from front to back on the wire shelf. Each divider 92 has a back clip 94 and a front bar 96 at opposite ends of the divider 92. The back clip 94 is adapted to engage the rear longitudinal wire 48 of the wire shelf 42 and secures the divider to the wire shelf. The front bar 96 of the divider 92 is adapted to engage a recess 98 formed in the front extrusion 82. Because the dividers 92 are removably secured to the wire shelf 42 and to the front extrusion 82, the dividers 92 may be adjusted on the shelf so as to accommodate products of differing sizes. As illustrated in FIG. 8, each of the dividers 92 extends below the plane P, defined by the transverse wires 46 of the wire shelf. A pair of adjacent dividers 92 and the wire shelf 42 define a track 10 0 in which a column of products 101 is located. The width of the track may be adjusted to accommodate different products by changing the location of the dividers relative to the wire shelf. Although one configuration of divider 92 is illustrated and described, other configurations of dividers are within the scope of the present invention, as well as other means to secure the dividers 92 to the wire shelf.

The present invention provides a display rack with extendible gravity feed shelves which enable product 101, as illustrated in FIG. 3, to be loaded on the rear of an extended shelf and to slide down the shelf to the front of the shelf where it is easily accessible to customers. The gravity feed shelf assemblies of the present invention may be extended from a retracted position and locked in an extended position in order to stock the rear of the shelf with product ensuring that older product is available at the front of the shelf.

While I have described only one preferred embodiment of the present invention, persons skilled in the art will appreciate changes and modifications which may be made to the present invention without departing from the spirit of the invention of this application. Therefore, I do not intend to be limited accept by the scope of the following claims:

I claim:

1. A display rack comprising:

a base, a pair of uprights extending upwardly from said base, a pair of support arms fixed to said pair of uprights, each of said support arms having an upwardly extending projection, a shelf assembly supported by said support arms and movable between a retracted position and an extended position, said shelf assembly comprising a wire shelf and a pair of slides secured to said wire shelf, each of said slides comprising an inner bracket and an outer bracket, each of said brackets having a recess, said recesses cooperating to define a cavity therebetween in which one of said support arms is slidably received, said cavity having a first extension and a second extension, said projections of said support arms being located in said first extensions when said shelf assembly is in said retracted position and being located in said second extensions when said shelf assembly is in said extended position.

2. The display rack of claim 1 wherein said shelf assembly further comprises a front extrusion extending between said slides and connected to said wire shelf.

3. The display rack of claim 1 further comprising dividers secured to said wire shelf.

4. The display rack of claim 1 wherein at least one of said brackets has a groove, said groove being adapted to receive and retain a portion of said wire shelf.

5. The display rack of claim 1 wherein said wire shelf has a pair of outermost side wires which are located in grooves formed in said slides of said shelf assembly.

6. The display rack of claim 1 wherein each of said brackets is molded plastic.

7. The display rack of claim 1 further comprising caster wheels secured to said base to enable said display rack to be moved from one location to another.

8. The display rack of claim 1 wherein said support arms are declined.

9. A display rack comprising:

a base, vertical uprights secured to said base, support arms fixed to said vertical uprights, said support arms extending outwardly from said vertical uprights, each of said support arms having a projection at an outer end of said support arm, a shelf assembly slidably engaged with a pair of said support arms, said shelf assembly being movable between a retracted position and an extended position, said shelf assembly comprising a shelf and a pair of slides secured to said shelf, each of said slides comprising an inner bracket and an outer bracket, each of said brackets having a recess, said recesses cooperating to define a cavity therebetween in which one of said support arms is slidably received, said cavity having first and second cavity extensions, said projections of said support arms being engaged with said first cavity extensions when said shelf assembly is in said retracted position and being engaged with said second cavity extensions when said shelf assembly is in said extended position whereby said shelf assembly is moved from said retracted position to said extended position by disengaging said projections of said support arms from said first cavity extensions by lifting said shelf assembly upwardly and inwardly.

10. The display rack of claim 9 wherein said shelf is a wire shelf having a generally planar supporting portion and a rear portion.

11. The display rack of claim 9 further comprising a plurality of removable dividers removably secured to said shelf.

12. The display rack of claim 9 wherein at least one of said brackets of each of said slides has a groove, said groove being adapted to receive and retain a portion of said shelf in order to secure said shelf to said slide.

13. The display rack of claim 9 wherein said shelf has a pair of outermost side wires which are located in grooves formed in said slides of said shelf assembly.

14. A shelf assembly for use in a display rack having a pair of support arms extending outwardly from said display rack, said shelf assembly being movable between a retracted position and an extended position and comprising:

a wire shelf and a pair of slides, each of said slides comprising an inner bracket and an outer bracket, each of said brackets having a recess, said recesses cooperating to define a cavity therebetween in which one of said support arms is slidably received, each of said support arms having a projection at an outer end of said support arm, said cavity having a first extension and a second extension, said projections of said support arms being located in said first extensions when said shelf assembly is in said retracted position and being located in said second extensions when said shelf assembly is in said extended position.

15. The shelf assembly of claim 14 further comprising a front extrusion extending between said slides, said front extrusion functioning as a stop to prevent product from falling off said wire shelf.

16. The shelf assembly of claim 14 further comprising at least one divider secured to said wire shelf, said at least one divider extending from front to back.

17. The shelf assembly of claim 14 wherein at least one of said brackets has a groove, said groove being adapted to receive and retain a portion of said wire shelf.

18. The shelf assembly of claim 14 wherein said wire shelf has a pair of outermost side wires which are located in grooves formed in said slides of said shelf assembly.

19. The shelf assembly of claim 15 wherein said front extrusion has a receptacle so that said front extrusion may be secured to a front wire of said wire shelf.

20. The shelf assembly of claim 16 wherein said at least one divider is secured to front and back wires of said wire shelf.

* * * * *